US005300218A

United States Patent [19]

Graiff et al.

[11] Patent Number: 5,300,218

[45] Date of Patent: Apr. 5, 1994

[54] REDUCTION OF DIESEL ENGINE PARTICULATE EMISSIONS BY CONTACTING DIESEL FUEL WITH A CARBON MOLECULAR SIEVE ADSORBENT

[75] Inventors: Leonard B. Graiff; Peter B. Van Benthuysen; Danny Y. Ngan; Zaida Diaz, all of Houston; David M. Austgen, Jr., Missouri City, all of Tex.

[73] Assignee: Shell Oil Company, Houston, Tex.

[21] Appl. No.: 902,604

[22] Filed: Jun. 23, 1992

[51] Int. Cl.[5] ..... C10G 25/00

[52] U.S. Cl. ..... 208/299; 208/310 R; 208/15; 585/820

[58] Field of Search ..... 208/299, 310 R, 310 Z, 208/15; 585/820

[56] References Cited

U.S. PATENT DOCUMENTS

| | | | |
|---|---|---|---|
| 2,395,491 | 2/1946 | Mavity | 585/828 |
| 2,716,144 | 8/1955 | Olsen | 208/310 R |
| 3,070,639 | 12/1962 | Geerts et al. | 585/831 |
| 3,211,644 | 10/1965 | Clark | 208/310 Z |
| 3,278,422 | 10/1966 | Epperly et al. | 208/310 R |
| 3,340,316 | 9/1967 | Wackher et al. | 208/310 R |
| 3,409,691 | 11/1968 | Small | 585/824 |
| 3,698,157 | 10/1972 | Allen et al. | 55/67 |
| 3,920,540 | 11/1975 | McCoy et al. | 208/299 |
| 3,922,217 | 11/1975 | Cohen et al. | 208/299 |
| 4,152,249 | 5/1979 | Avrillon et al. | 208/299 |
| 4,337,156 | 6/1982 | De Rosset | 210/672 |
| 4,447,315 | 5/1984 | Lamb | 208/99 |
| 4,608,153 | 8/1986 | Hudson et al. | 208/112 |
| 4,618,412 | 10/1986 | Hudson et al. | 208/59 |
| 4,624,776 | 11/1986 | Long et al. | 208/302 |
| 4,698,146 | 10/1987 | Gruia | 208/86 |
| 4,775,460 | 10/1988 | Reno | 208/91 |
| 4,804,457 | 2/1989 | Ngan | 208/64 |
| 4,912,873 | 4/1990 | Diaz et al. | 208/299 |

*Primary Examiner*—R. Bruce Breneman
*Assistant Examiner*—Walter D. Griffin
*Attorney, Agent, or Firm*—Timothy J. Hadlock

[57] ABSTRACT

This invention is a method for reducing the particulate emissions tendency of diesel fuel. Also the piston ring sticking, and deposit formation tendency of diesel fuel on the injector and combustion chamber of an internal combustion diesel fuel are reduced. The diesel fuel under the method of this invention is fed to at least one adsorbent bed in which the diesel fuel is contacted with one or more adsorbents under suitable process conditions such that there is a reduction in content of impurities in the fuel which cause the particulate emission causing tendency, piston ring sticking, and deposit formation tendency of the diesel fuel on the injector and/or combustion chamber.

9 Claims, No Drawings

REDUCTION OF DIESEL ENGINE PARTICULATE EMISSIONS BY CONTACTING DIESEL FUEL WITH A CARBON MOLECULAR SIEVE ADSORBENT

FIELD OF THE INVENTION

This invention relates to a process for reducing diesel engine particulate emissions by contacting the diesel fuel with one or more adsorbents prior to combusting the diesel fuel in the engine.

BACKGROUND OF THE INVENTION

Particulate emissions in diesel engines are caused in part by impurities in the diesel fuel such as ultraviolet light absorbing compounds ("UV absorbers") and polar heteroatom containing compounds. Piston ring sticking and deposit formation on the injector in the engine are also caused by these impurities and also contribute to particulate emissions. Accordingly, it would be advantageous to have diesel fuel compositions and methods of making such compositions which lack, or have a reduced concentration of, UV absorbers and polar heteratom compounds. Such compositions cause reduced particulate emissions, reduced injector and combustion chamber deposits and reduced piston ring sticking tendencies.

SUMMARY OF THE INVENTION

The present invention relates to a method for reducing the particulate emissions tendency of diesel fuel, piston ring sticking, and deposit formation tendency of diesel fuel on the injector and combustion chamber of an internal combustion diesel fuel engine by: (1) feeding the diesel fuel containing particulate emission causing impurities to at least one adsorbent bed; and (2) contacting the diesel fuel with at least one adsorbent under suitable process conditions such that the content of said impurities is reduced.

DETAILED DESCRIPTION OF THE INVENTION

The invention will be more clearly understood from the following description.

The types of diesel fuel engines for use with all the embodiments of the invention include both the direct injection and the indirect injection (i.e., prechamber) type engines. Diesel fuel includes a hydrocarbon feed stock in about the 400° F. to 700° F. boiling point range. One aspect of this invention is a method for reducing particulate emissions forming tendency (preferably by 15 wt %) and/or piston ring sticking and/or the fouling, gumming, and deposit formation tendency of diesel fuel on the injector and combustion chamber of an internal combustion diesel fuel engine. All of the impurities which cause particulate emissions have not been identified. Certain compounds have been identified as indicators of removal of particulate causing compounds generally. These include N, S, and other polar heteroatom containing compounds. Other such compounds are those which absorb UV light in the 360–550 nm integrated range. Accordingly, one embodiment of this aspect of the present invention is (1) feeding the diesel fuel to at least one adsorbent bed; and (2) contacting the diesel fuel with at least one adsorbent under suitable process conditions such that the particulate emissions causing impurities present, including those indicated by the 360–550 nm integrated UV absorbance of the diesel fuel and/or polar heteroatom compound, e.g., nitrogen and sulfur, content of the diesel fuel, are lowered an effective amount to reduce deposit formation and particulate emissions; and (3) recovering the treated diesel fuel having a reduced fouling, gumming, and deposit formation tendency.

One or more adsorbents are suitable in practicing the instant invention. Adsorbents are suitably used individually or together in one or more beds. Multiple adsorbents are mixed either randomly or in a planned manner. The adsorbents are suitably matched to the type of whole diesel fuel or diesel fuel stream treated.

Suitable adsorbents will be carbonaceous and/or contain polar sites. These include acid activated carbon, activated carbon, carbon molecular sieves, sodium exchanged acid active carbon, polymeric adsorbents such as Rohm & Haas XAD-7, strong acid ion exchange resins such as DOWEX MSC-1, alumina, large pore zeolites (pore size greater than 4.8A°), especially ultrastable Y (USY), including $H^+$, $NH_4^+$, rare earth, and SC USY, very ultrastable Y (VUSY), clays, especially acid clays and ammonium clays, zirconia and acid-modified oxides, hydrated niobium oxide, silica alumina and silica, especially if modified to make it organophilic. Other suitable adsorbents are calcium oxide; calcined calcium oxide; sodalime; sodalime supported on alumina; magnesia; magnesia modified with alkali metal hydroxides; potassium carbonate; slaked lime (calcium hydroxide); slaked lime modified with alkali metal hydroxides; calcined alumina; alkali metal impregnated alumina; alkali metal hydroxide impregnated alumina; alkaline earth metal hydroxide impregnated alumina; alumina impregnated with alkaline earth nitrates subsequently precipitated with excess alkali metal hydroxides; alumina impregnated with potassium carbonate and calcined to decompose the carbonate; basic minerals such as hydrotalcite and cacoxenite; base treated clays such as calcium montmorillonite, wollastonite, and bentonite; and base treated oxides such as zirconia, alumina, titania, iron oxide, and the like.

Particularly suitable are active carbon, acid active carbon, carbon molecular sieves (CMS) with or without binders, zeolite USY, strong acid ion exchange resins, e.g., DOWEX MSC-1, AMBERLYST 15, and AMBERLYST XN-1010, and alumina, and supported bases having a moderate to high surface area (50 or more $m^2/g$) prepared by precipitation of alkaline earth oxides with alkali metal hydroxides or by decomposition of alkali metal carbonates. Seven to 10 wt % water in USY-$H^+$ provides good results. Acid activated carbon (AAC) is prepared, for example, as described in U.S. Pat. No. 4,547,619 (filed Dec. 24, 1984), which disclosure is incorporated herein by reference. Carbon molecular sieves are described by T. M. O'Grady and A. N. Wennerberg in *High Surface Area Active Carbon. Petroleum-Derived Carbons* 302 (ACS Symposium Series 303, American Chemical Society, Washington, D.C. 1986) and are available from Anderson Development Company.

The temperature of contacting the diesel fuel and adsorbent for all embodiments is between about 30° F. and about 800° F., preferably between 50° F. and 400° F., and most preferably between 50° F. and 200° F. The diesel fuel is contacted with the adsorbent at a liquid hourly space velocity between about 0.5 and 30. The pressure is ambient pressure or alternatively is adjusted to be compatible with the relevant refinery process units. The mean residence time is between about 2 and 120 minutes or preferably a duration less than the time necessary to saturate the adsorbent. At the point of saturation the particulate emission causing impurities such a the UV absorbers and/or polar heteroatoms containing compounds will no longer be adsorbed.

At a point in time prior to saturation the diesel fuel feed should be switched to a fresh adsorbent bed and the nearly saturated bed should be regenerated. A regeneration step is suitably included in all of the embodiments of this invention. The regeneration can be achieved by contacting the spent adsorbent with a regenerant stream under conditions which cause the adsorbed compounds to be sufficiently desorbed to restore the adsorptive capacity of the adsorbent and then purging the adsorbent to remove the regenerant. Such regeneration is well known.

A more specific aspect of the present invention is a method for reducing the tendency of a diesel fuel containing nitrogen and/or oxygen containing compounds to cause particulate emissions, piston ring sticking, and deposits, fouling, and gumming on the injectors and the combustion chamber of an internal combustion diesel engine. The method includes the following steps: (1) feeding the diesel fuel to at least one adsorbent bed; (2) contacting the diesel fuel with at least one adsorbent selective for the removal of nitrogen and/or oxygen containing compounds under suitable process conditions such that a portion of the nitrogen and/or oxygen containing compounds are adsorbed by the adsorbent; and (3) recovering the diesel fuel having a smaller content of the nitrogen and/or oxygen containing compounds. The preferred adsorbents of this embodiment are selected from the group consisting of acid zeolites, Sc/USY, USY, strong acid ion exchange resins, alumina, acid activated carbon, alumina containing basic metal oxides, and mixtures thereof.

The present invention is suitably used at different points in the processing of hydrocarbons into a final diesel fuel product. It is used on any individual refinery unit's product stream separately or on a combination of two or more refinery units' product streams. Also, the method is preferably used on diesel fuel prior to the addition of any diesel fuel oxygenate or additives where examples of additives include detergents, antioxidants, and haze eliminators.

The present invention also includes a diesel fuel composition mixture having a reduced tendency to cause particulate emissions and piston ring sticking and engine deposits whenever prepared by the above-described methods.

The ranges and limitations provided in the instant specification and claims are those which are believed to particularly point out and distinctly claim the instant invention. It is, however, understood that other ranges and limitations that perform substantially the same function in substantially the same way to obtain substantially the same result are intended to be within the scope of the instant invention as defined by the instant specification and claims.

The invention will be described by the following example which is provided for illustrative purposes and is not to be construed as limiting the invention:

EXAMPLE

Batch Equilibrium Shake Tests Comparinq Adsorption Capabilities of Adsorbents In this example, adsorbents were used to treat diesel fuel. The untreated diesel fuel was a commercially available fuel from a truck-stop diesel fuel dispenser. The diesel fuel was tested for initial and final nitrogen and sulfur compound content. It was also tested for initial and final integrated UV absorbance. The results thus indicate which adsorbents are more effective in removing heteroatom compounds, where nitrogen and sulfur are used as indicators of heteroatom compounds, and UV absorbing compounds. The results are indicated in the Table below.

Test Procedure for Batch Equilibrium Shake Tests

The following steps were followed in performing the tests:

1) Adsorbents were dried for 16 to 24 hours at about 212° F. to about 230° F. under vacuum.
2) In a 100 ml to 1 liter screw-cap glass bottle, a mixture was prepared consisting of 10 g dried adsorbent and 100 g of diesel fuel. The bottle was sealed.
3) The adsorbent-diesel fuel mixture was placed in a shaker bath. The bath was operated at room temperature for about 20 to about 60 seconds of each minute. Each mixture was shaken for a total of 16 to 24 hours.
4) Supernatant diesel fuel was filtered from the mixture with a 0.45 micron teflon syringe filter.
5) The filtered supernatant was analyzed by UV spectroscopy (Integrated procedure) and for total nitrogen content and sulfur content. The integrated UV absorbance in the 360–550 nm range was determined by the method described below. Nitrogen content wa measured by chemiluminescence. Sulfur content was determined by UV fluorescence.

The adsorbents used in the Table are activated carbon and acid activated carbon. The activated carbon was obtained from Calgon and is designated by Calgon as "CAL" activated carbon. The acid activated carbon was prepared from "CAL" carbon following the procedure described in U.S. Pat. No. 4,547,619.

UV Measurement Method Summary

The method used to measure reduction in UV absorbing compounds was designed to give the integrated absorbance of liquids between desired wavelength limits in the spectral region above 310 nm. The sample must be a nonscattering liquid or a liquid which when dissolved in toluene becomes nonscattering. The reported result is the integrated absorbance, in units of nm/cm, of the liquid or of a diluted solution of the liquid corrected to the neat sample on the basis of a volumetric dilution factor. All results are corrected to 1 cm path length. The method requires a scanning spectrophotometer, either single- or double-beam. Perkin-Elmer Lambda 7 or Lambda 9 spectrophotometers on 7000 series data stations may be used.

UV Measurement Data Analysis

Calculate the integrated absorbance (the area under the baseline-corrected absorbance curve) between the desired wavelength limits above 310 nm. The resultant area should be in units of nm. In all cases the absorbance measurements within the desired wavelength limits must be below 2.0 absorbance units. If the recorded absorption spectrum contains absorbance data in the desired wavelength range which is above 2.0 absorbance units, the data collection procedure must be repeated by either (a) using shorter pathlength cuvettes or (b) diluting the sample. Dilutions should be performed volumetrically using toluene as diluent.

TABLE

Removal of Polar Heteratom and UV Absorbing Compounds from Diesel Fuel by Adsorption

| | UV-Integrated 360–550 nm | N, ppm | S, % wt |
|---|---|---|---|
| Untreated diesel fuel | 640 | 181 | 0.187 |
| Treated with activated carbon | 289 | 132 | 0.164 |
| Treated with acid activated carbon | 225 | 31 | 0.159 |

As indicated in the Table, activated carbon and particularly acid activated carbon has very beneficial adsorption capabilities for removing polar heteratom compounds, where N and S compounds are indicators of polar heteroatom compound removal, and removing UV absorbing compounds from diesel fuel.

We claim:

1. A process for reducing the particulate emissions tendency of a diesel fuel from a diesel engine consisting essentially of:

(1) contacting a diesel fuel containing particulate-emission-causing impurities with at least one carbon molecular sieve adsorbent at a liquid hourly space velocity between about 0.5 and 30, ambient pressure, and at a temperature between 30° F. and 800° F. in at least one adsorbent bed under effective adsorption conditions such that said impurities content is reduced; and (2) recovering the diesel fuel having a lower content of said impurities.

2. The process according to claim 1 wherein the diesel fuel before the contacting step (1) contains said impurities which include UV absorbing compounds in the 360–550 nm UV absorbance spectra and wherein during contacting a portion of said UV absorbing compounds are adsorbed wherein the diesel fuel recovered in step (2) contains a lesser amount of said UV absorbing compounds.

3. The process according to claim 1 wherein the diesel fuel before the contacting step (1) contains said impurities which include polar heteroatom containing compounds and wherein during contacting a portion of said polar heteroatom containing compounds are adsorbed wherein the diesel fuel recovered in step (2) contains a lesser amount of said polar heteroatom containing compounds.

4. The process according to claim 3 wherein the diesel fuel before the contacting step (1) contains said polar heteroatom compounds which comprise sulfur containing compounds and wherein during contacting a portion of said sulfur containing compounds are adsorbed wherein the diesel fuel recovered in step (2) contains a lesser amount of said sulfur containing compounds.

5. The process according to claim 3 wherein the diesel fuel before the contacting step (1) contains said polar heteroatom compounds which comprise nitrogen containing compounds and wherein during contacting a portion of said nitrogen containing compounds are adsorbed wherein the diesel fuel recovered in step (2) contains a lesser amount of said nitrogen containing compounds.

6. The process according to claim 3 wherein the diesel fuel before the contacting step (1) contains said polar heteroatom compounds which comprise oxygen containing compounds and wherein during contacting a portion of said oxygen containing compounds are adsorbed wherein the diesel fuel recovered in step (2) contains a lesser amount of said oxygen containing compounds.

7. The process according to claim 3 wherein said particulate emissions tendency of said recovered diesel fuel is reduced.

8. A process for reducing the particulate emissions tendency of a diesel fuel from a diesel engine consisting essentially of:

(1) contacting a diesel fuel which contains impurities which include UV absorbing compounds in the 360–550 nm UV absorbance spectra and polar heteroatom containing compounds with at least one carbon molecular sieve adsorbent at a liquid hourly space velocity between about 0.5 and 30, ambient pressure, and at a temperature between about 30° F. and 800° F. in at least one adsorbent bed under effective adsorption conditions such that said impurities content is reduced; and (2) recovering the diesel fuel having a lower content of said UV absorbing compounds in the 360–550 nm UV absorbance spectra and a lower content of said polar heteroatom containing compounds.

9. The process according to claim 8 wherein said particulate forming tendency of said recovered diesel fuel is reduced.

* * * * *